US006622435B1

(12) United States Patent
Long et al.

(10) Patent No.: US 6,622,435 B1
(45) Date of Patent: Sep. 23, 2003

(54) SNOW AND ICE DIVERTING APPARATUS

(76) Inventors: Rick A. Long, P.O. Box 326, Sagle, ID (US) 83860; Roy Long, 6920 N. Boyer, Sandpoint, ID (US) 83864

( * ) Notice: Subject to any disclaimer, the term of this patent is extended or adjusted under 35 U.S.C. 154(b) by 0 days.

(21) Appl. No.: 10/119,832

(22) Filed: Apr. 11, 2002

(51) Int. Cl.[7] ..... E04D 13/10
(52) U.S. Cl. ..... 52/24; 52/219; 52/146
(58) Field of Search ..... 52/24, 219, 146, 52/149; 24/27, 135 R, 135 N

(56) References Cited

U.S. PATENT DOCUMENTS 2,485,445 A * 10/1949 Hoffman
4,414,715 A * 11/1983 Anjos et al.
4,662,035 A * 5/1987 Hatfiled
4,974,549 A * 12/1990 Gordon
5,077,943 A * 1/1992 McGady
5,673,520 A * 10/1997 Yannucci
6,446,474 B1 * 9/2002 Tabacchi et al.

FOREIGN PATENT DOCUMENTS

EP 0 666 444 A1 * 8/1995 ..... F16L/3/137
GB 2245772 A * 1/1992 ..... H01R/4/30

OTHER PUBLICATIONS http://www.ventsaver.com, 2 pages, Feb. 6, 2002.* http://www.archive.org/web/20020206083019/http://www.ventsaver.com/, 2 pages, Jan. 24, 2003.*

* cited by examiner

*Primary Examiner*—Robert Canfield
(74) *Attorney, Agent, or Firm*—Sughrue Mion, PLLC

(57) ABSTRACT

A snow and ice diverting apparatus for protecting a roof stack, the snow and ice apparatus having a base angle for securing the apparatus to a roof, a fin for cutting through sliding snow and ice and for diverting snow and ice from the roof stack, and an adjustment device for securing the fin to the roof stack. The fin is attached between the base angle and the adjustment device. The adjustment device is operable to allow infinite adjustability over a predetermined range of roof stack sizes. In addition, the adjustment device has a cable, which has an eye end and a free end, and a retainer device for securing the eye end and the free end of the cable. The cable is in communication with the roof stack and the retainer device. The retainer device is attached to said fin.

8 Claims, 2 Drawing Sheets

SNOW AND ICE DIVERTING APPARATUS

BACKGROUND OF THE INVENTION

The present invention relates to an apparatus for diverting snow and ice on a roof to prevent damage to roof stacks, vent pipes, chimneys, and masts; more particularly, to an improved snow and ice diverting apparatus having an adjustable device capable of infinite adjustability between a minimum and maximum size; and even more particularly, to an improved snow and ice diverting apparatus having an adjustment device comprising a retainer device and a cable assembly.

It is known that glacial and sliding action of snow and ice on roofs can cause breakage or damage to roof stacks, vent pipes, chimneys, and masts. Even the slow, down-slope creep of snow on relatively low-sloped metal roofs can shear off plumbing vents. Conventional sheet metal crickets have been used to protect roof stacks, vent pipes, chimneys, and masts from damage caused by ice and snow. However, installation of crickets is labor intensive and costly. In addition, crickets typically occupy large amounts of space and are unattractive.

Other conventional apparatus for diverting snow and ice use a fin and base design to protect roof stacks, roof vents, etc. In these conventional apparatus, an aluminum fin is used to cut through the sliding snow and ice and divert the snow and ice from the roof stack, roof vent, etc. In the conventional fin design, a base angle is attached to the roof using a plurality of screws. The bottom portion of the fin is attached to the base angle using a plurality of bolts. A pre-punched stainless steel strap is positioned around the roof stack, vent pipe, etc. The pre-punched holes in the stainless steel strap are sized for specific plumbing stack sizes, for example, 1-½", 2", 3", and 4". The stainless steel strap is attached to the upper portion of the aluminum fin.

However, the conventional fin apparatus is limited in its application and lacks versatility because it is limited to specific plumbing stack sizes by the pre-punched holes in the stainless steel strap. Moreover, the conventional apparatus is limited in its application to plumbing stacks of varying shapes. It is therefore desirable to have a fin and base apparatus that has an adjustment device capable of infinite adjustability over a range of sizes to enable the snow and ice diverting apparatus to be installed on a variety of roof stacks, vent pipes, chimneys, and masts.

SUMMARY OF THE INVENTION

It is therefore an object of this invention to provide a snow and ice diverting apparatus that prevents damage or breakage to roof stacks, vent pipes, chimneys, and masts.

It is another object of the present invention to provide a fin and base apparatus that reduces the time and complexity of installation, reduces costs, and is more attractive.

It is a further object of the present invention to provide a fin and base, snow and ice diverting apparatus that is not limited in its application and that is versatile and capable of installation on both standard sized and non-standard sized roof stacks, vent pipes, chimneys, and masts on any existing roof or new construction.

It is yet another object of the present invention to provide a fin and base snow and ice diverting apparatus that can easily and quickly be installed on both new and existing roof stacks, vent pipes, chimneys, and masts.

It is still another object of the present invention to provide a snow and ice diverting apparatus that provides additional support and strength to roof stacks, vent pipes, chimneys, and masts.

It is a further object of the invention to provide a snow and ice diverting apparatus that is resistant to exposure to varying weather conditions.

Further objects, features and advantages of the invention will become apparent from the consideration of the following description and the appended claims when taken in connection with the accompanying drawings.

BRIEF DESCRIPTION OF THE DRAWINGS

The above aspects of the present invention will become more apparent by describing in detail embodiments thereof with reference to the attached drawings in which.

DETAILED DESCRIPTION OF THE INVENTION

Hereinafter, embodiments of the present invention will be described in detail with reference to the attached drawings. The present invention is not restricted to the following embodiments, and many variations are possible within the spirit and scope of the present invention. The embodiments of the present invention are provided in order to more completely explain the present invention to one skilled in the art.

A non-limiting embodiment of an improved snow and ice diverting apparatus that solves the aforementioned problems, and others, is now described with reference to FIGS. 1–4.

Figure 1:
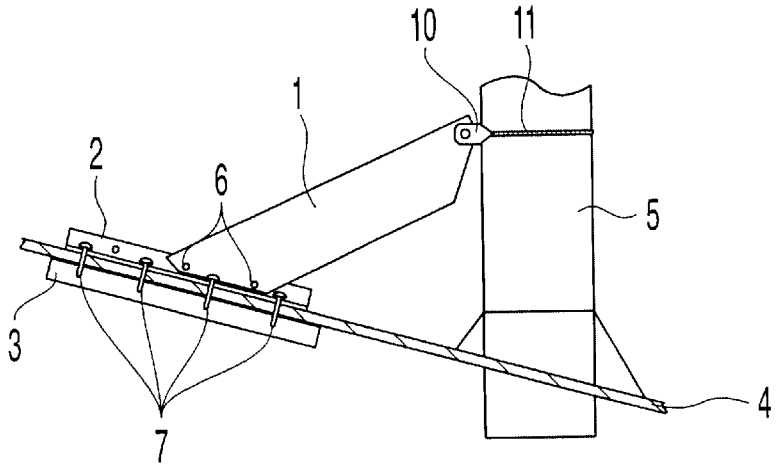
FIG. 1 is a side view depicting a snow and ice diverting apparatus having an adjustment device according to a preferred embodiment of the present invention.

FIG. 1 depicts a side view of a snow and ice diverting apparatus having an adjustment device 10, according to a preferred embodiment of the present invention. As shown in FIG. 1, a vent pipe 5 rises from a sloped roof 4. The snow and ice diverting apparatus is attached to both the roof 4 and the vent pipe 5. The snow and ice diverting apparatus comprises a base angle 2, a fin 1, an adjustment device 10, and a cable 11.

The base angle 2 is attached to the roof 4 using a plurality of fasteners 7, such as #14×1-½" hex head, wood grip, self-sealing lag screws. The base angle 2 is preferably formed from 6061 T6 aircraft aluminum. In the preferred embodiment, the size of the base angle 2 is 3⁄16"×1-½"×1-½"×8". In addition, a 2"×10" wood block 3, or the like, can be positioned under the roof 4. The fasteners 7 can be additionally fastened to the wood block 3 to provide additional strength in heavy snow areas.

As shown in FIG. 1, a fin 2 is attached to the angle base 2 using a plurality of bolts 6. The fin is preferably constructed from 6061 T6 aircraft grade aluminum. In the preferred embodiment, the size of the fin 1 is 3⁄16"×3"×12". The bolts 6 are preferably ¼"×¾" stainless steel bolts with stainless steel lock nuts.

Figure 2:
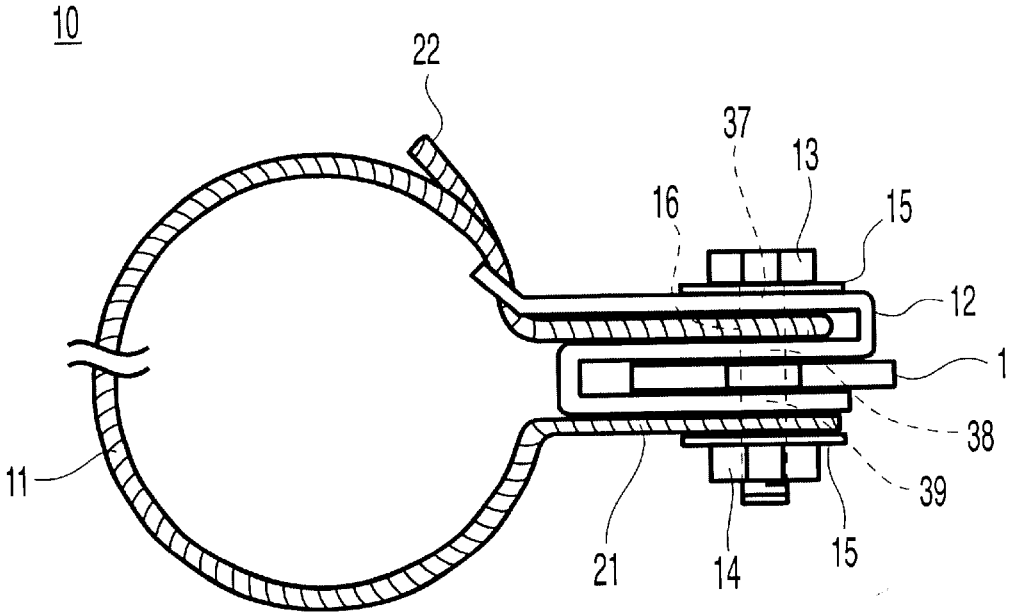
FIG. 2 is a plan view depicting an adjustment device and cable assembly of a snow and ice diverting apparatus according to a preferred embodiment of the present invention.
Figure 3:
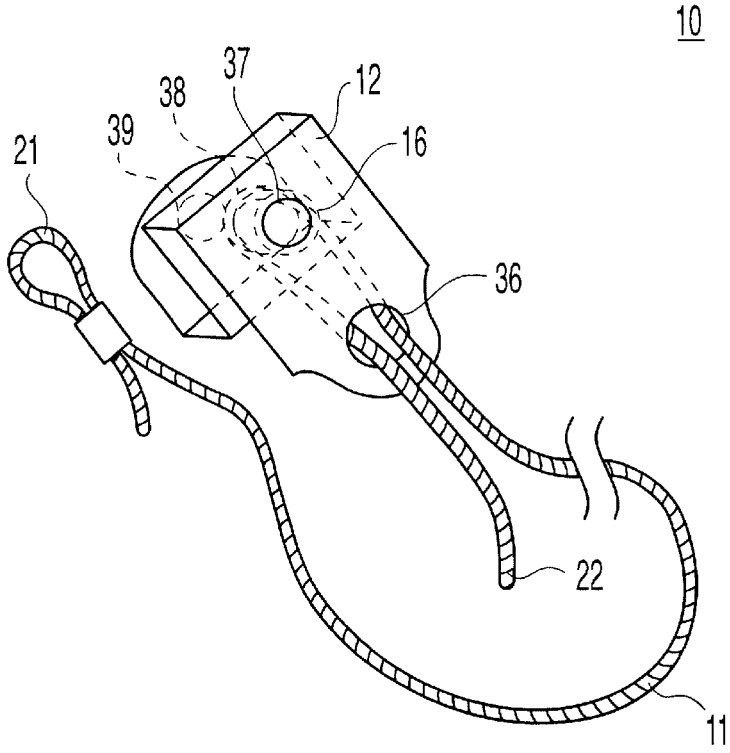
FIG. 3 is a perspective view depicting an adjustment device and cable assembly of a snow and ice diverting apparatus according to a preferred embodiment of the present invention.

FIGS. 2 and 3 depict an improved adjustment device for a snow and ice diverting apparatus according to a preferred embodiment of the present invention. As shown in FIGS. 2 and 3, the adjustment device comprises a retainer device 12, a cable 11, a plurality of washers 15, a nylon roller or spacer 16, a bolt 13, and a lock nut 14.

In the preferred embodiment of the present invention, the retainer device 12 is a 0.030×¾" Type 201 stainless steel S-shaped retainer device having punched holes 36–39, as shown in FIGS. 2 and 3. In addition, the plurality of washers 15 are preferably ¼" stainless steel flat washers. Furthermore, the bolt 13 is preferably a ¼"×1" stainless steel bolt with a stainless steel lock nut 14. In addition, the cable 11 is preferably ⅛"7×19 galvanized aviation cable with an eye end 21 and free end 22.

The components of the present invention are not limited to the preferred embodiment. Alternative materials that possess the requisite strength and durability, and that are resistant to varying weather conditions, may be substituted. In addition, the components can be manufactured with a variety of finishes, for example, S151 polished aluminum finish, P151 gray powder coat finish, or FB 151 black powder coat finish.

Figure 4:
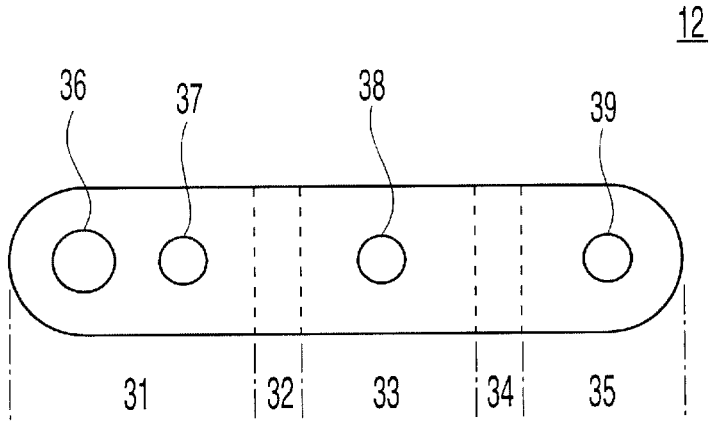
FIG. 4 is a plan view depicting the hole layout of a retainer device according to a preferred embodiment of the present invention.

FIG. 4 depicts the layout of the holes 36–39 of a retainer device 12 of the adjustment device 10, according to a preferred embodiment of the present invention. As shown in FIG. 4, the stainless steel S-shaped retainer device 12 has holes 36–39 punched through its surface portions 31–35. The hole 36 is preferably larger than holes 37–39 in order to accommodate at least two thicknesses of the cable 11, as shown in FIG. 3. Holes 37–39 are sized corresponding to the size of the bolt 13. In the preferred embodiment, hole 36 has a 9/32" diameter and holes 37–39 have ¼" diameters.

The S-shaped retainer device 12 is formed by bending the retainer device 12, depicted in FIG. 4, to form a first bend 32 and a second bend 34. Holes 36 and 37 are positioned in the first outside surface 31, hole 38 is positioned in the inside surface 33, and hole 39 is positioned in the second outside surface 35. The retainer device 12 is formed so that the holes 37–39 are axially aligned. Other manufacturing methods may also be used to form the retainer device 12 without deviating from the scope of the present invention.

As shown in FIGS. 2–4, a nylon roller 16 is preferably disposed between the first outside surface 31 of the retainer 12 and the inside surface 33 of the retainer 12, and axially aligned with the holes 37 and 38. The nylon roller 16 is hollow with an inside diameter corresponding to the diameter of the bolt 13. In other embodiments of the present invention, the nylon roller 16 may extend along a greater length of the bolt 13. In addition, the diameter of the holes 37–39 can be increased to accommodate the bolt 13 having the nylon spacer 16 surrounding a length of the bolt 13, whereby both the bolt 13 and the nylon spacer 16 are inserted through one or all of the holes 37–39. Moreover, the roller or spacer 16 can be formed from other friction reducing materials to permit the cable 11 to slide more easily.

With reference to FIGS. 1–3, the snow and ice deflecting apparatus is assembled by first attaching the fin 1 to the base angle 2 using stainless steel bolts 6. Next, the base angle 2 is centered on the roof 4 upstream of the vent pipe 5 so that the opposite end of the fin 1 is in close proximity to the vent pipe 5. A sealant is then applied to the underside of the base angle 2 and the base angle 2 is attached to the roof 4 using lag screws 7. If the roof 4 has a rib structure, the base angle 2 can be reversed so that the base angle 2 overlays the peaked surface of the rib structure.

The adjustable device 10 is assembled by first inserting the bolt 13 through a washer 15 and then through a hole 37 of the retainer device 12. The bolt 13 is then inserted through the nylon roller 16, which is axially aligned between holes 37 and 38. Next, the bolt 13 is inserted through hole 38. In order to fasten the fin 1 to the retainer device of the adjustment apparatus 10, the upper end of the fin 1 is disposed between the first outside surface 31 of the retainer device 12 and the inside surface 33 of the retainer device 12. The bolt 13 is further inserted through a hole in the fin 1, which is also axially aligned with the holes 37–39, and then inserted through the hole 39. After the bolt 13 is completely inserted through holes 37–39 of the retainer device 12, the eye end 21 of the cable 11 is positioned over the end of the bolt 13 that projects from the retainer device 12. A washer 15 is also positioned over the projecting end of the bolt 13. A lock nut 14 is then fastened to the bolt 13 to secure the assembled components of the adjustable assembly 10.

Next, the cable 11 is placed over the vent pipe 5, or alternatively, the free end 22 of the cable 11 is wrapped around the vent pipe 5. As shown in FIG. 2, the eye end 21 of the cable 11 is secured to the retainer device 12 by the washer 15 and lock nut 14. The free end 22 of the cable, which has been wrapped around the vent pipe 5, is inserted through hole 36 of the retainer device 12, wrapped around the nylon roller 16, which is disposed between the first outside surface 31 and the inside surface 33 of the retainer device 12, and then inserted back through the hole 36, as shown in FIGS. 2 and 3.

The free end 22 of the cable 11 is pulled using a pair of pliers so that the cable 11 is taut around the vent pipe 5. The nylon spacer 16 reduces the friction on the cable 11 as it pulled into a taut position. The bolt 13 and lock nut 14 are then tightened to compress the S-shaped retainer device 12, thereby securing the cable 11 in a fixed position around the nylon spacer and between the first outside surface 31 and the inside surface 33 of the retainer device 12. In addition, the retainer device 12 is held in a fixed position with respect to the fin 1, which is secured between the inside surface 33 and the second outside surface 35 of the retainer device 12. Finally, the eye end 21 of the cable 11 is secured in a fixed position between the second outside surface 35 and the washer 15. Any excess cable 11 at the free end 22 of the cable 11 can be removed.

In another embodiment of the present invention, the retainer device 12 is U-shaped. For example, the U-shaped retainer device comprises the first outside surface 31 and the inside surface 33. In this embodiment, the second outside surface 35 is eliminated. The eye end 21 of the cable 11 is then positioned between the fin 1 and the washer 15. Alternatively, an additional washer, or a plate, can be inserted between the fin 1 and the eye end 21 of the cable 11.

In another embodiment of the present invention, a push retainer for a threaded bolt can be used to secure the eye end 21 of the cable 11 to the retainer device 12.

In yet another embodiment of the present invention, a plate, washer, push retainer, or the like, can be substituted for one or more of the surfaces 31, 33, and 35 of the retainer device.

Thus, the snow and ice diverting apparatus having the improved adjustment device 10 according to the present invention solves the aforementioned problems by permitting the application of the snow and ice diverting apparatus to virtually any size of roof stack 5, or other roof mounted object. In addition, because the improved snow and ice apparatus is quickly and easily attached and adjusted to any size roof stack 5, installation costs can be greatly reduced. Further, the improved adjustment device 10 comprising the cable 11 permits the application of the snow and ice diverting apparatus to roof stacks, vent pipes, chimneys, and masts of varying shapes and proportions. Further, the improved adjustment device 10 permits adjustment of the apparatus to an infinite number of sizes over the length of the cable 11. Moreover, the length of the cable 11 of the adjustment device 10 can be varied to provide increased applicability.

What is claimed is:

1. A snow and ice diverting apparatus for protecting a roof stack, said apparatus comprising:

a base angle for securing said apparatus to a roof;

a fin for cutting through sliding snow and ice and for diverting snow and ice from said roof stack; and an adjustment device for securing said fin to said roof stack;

wherein said fin is attached between said base angle and said adjustment device;

wherein said adjustment device is operable to allow infinite adjustability over a predetermined range of roof stack sizes;

wherein said adjustment device further comprises:

a cable having a first and second end and a retainer device for securing said first and second ends of said cable, wherein said cable is in communication with said roof stack and said retainer device, wherein said retainer device is attached to said fin, and wherein said retainer device comprises an S-shaped device having a plurality of holes therein for accommodating a fastener.

2. The snow and ice diverting apparatus according to claim 1, further comprising at least one fastener for compressing said retainer device to secure said first and second ends of said cable to said retainer device.

3. The snow and ice diverting apparatus according to claim 1, wherein said adjustment device is formed from a weather resistant material.

4. A snow and ice diverting apparatus for protecting a roof stack, said apparatus comprising:

a base angle for securing said apparatus to a roof;

a fin for cutting through sliding snow and ice and for diverting snow and ice from said roof stack; and an adjustment device for securing said fin to said roof stack;

wherein said fin is attached between said base angle and said adjustment device;

wherein said adjustment device is operable to allow infinite adjustability over a predetermined range of roof stack sizes;

wherein said adjustment device further comprises:

a cable having a first and second end and a retainer device for securing said first and second ends of said cable, wherein said cable is in communication with said roof stack and said retainer device, wherein said retainer device is attached to said fin, and further comprising a spacer for reducing friction between said retainer device and said cable.

5. The snow and ice diverting apparatus according to claim 4, wherein said spacer guides said cable.

6. The snow and ice diverting apparatus according to claim 4, wherein said spacer is a roller for reducing friction between said retainer device and said cable.

7. A snow and ice diverting apparatus for protecting a roof stack, said apparatus comprising:

a base angle for securing said apparatus to a roof;

a fin for cutting through sliding snow and ice and for diverting snow and ice from said roof stack; and an adjustment device for securing said fin to said roof stack;

wherein said fin is attached between said base angle and said adjustment device;

wherein said adjustment device is operable to allow infinite adjustability over a predetermined range of roof stack sizes;

wherein said adjustment device further comprises:

a cable having a first and second end and a retainer device for securing said first and second ends of said cable, wherein said cable is in communication with said roof stack and said retainer device, wherein said retainer device is attached to said fin, and wherein said retainer device comprises a U-shaped device having a plurality of holes therein for accommodating at least one fastener.

8. A snow and ice diverting apparatus for protecting a roof stack, said apparatus comprising:

a base angle for securing said apparatus to a roof;

a fin for cutting through sliding snow and ice and for diverting snow and ice from said roof stack; and an adjustment device for securing said fin to said roof stack;

wherein said fin is attached between said base angle and said adjustment device;

wherein said adjustment device is operable to allow infinite adjustability over a predetermined range of roof stack sizes;

wherein said adjustment device further comprises:

a cable having a first and second end and a retainer device for securing said first and second ends of said cable, wherein said cable is in communication with said roof stack and said retainer device, wherein said retainer device is attached to said fin, and wherein said first end of said cable is an eye end.

* * * * *